US008164402B2

(12) United States Patent
Bergamini et al.

(10) Patent No.: US 8,164,402 B2
(45) Date of Patent: Apr. 24, 2012

(54) CURRENT TRANSFORMER, PROTECTION DEVICE INCLUDING SUCH TRANSFORMER AND RELATED CIRCUIT BREAKER

(75) Inventors: Alessio Bergamini, Ardesio (IT); Federico Gamba, Bergamo (IT)

(73) Assignee: ABB S.p.A., Milan (IT)

( * ) Notice: Subject to any disclaimer, the term of this patent is extended or adjusted under 35 U.S.C. 154(b) by 176 days.

(21) Appl. No.: 12/789,028

(22) Filed: May 27, 2010

(65) Prior Publication Data

US 2010/0301980 A1 Dec. 2, 2010

(51) Int. Cl.
*H01H 75/00* (2006.01)
*H01F 5/00* (2006.01)
*H01F 27/08* (2006.01)

(52) U.S. Cl. ..... 335/6; 335/18; 335/300; 336/55; 336/61; 336/175

(58) Field of Classification Search ..... 335/6–8, 335/18, 19, 300; 336/55, 61, 175
See application file for complete search history.

(56) References Cited

U.S. PATENT DOCUMENTS 3,816,682 A * 6/1974 MacBeth ..... 218/72
4,123,618 A * 10/1978 Cushing et al. ..... 174/11 BH

* cited by examiner

*Primary Examiner* — Ramon Barrera
(74) *Attorney, Agent, or Firm* — Paul R. Katterle

(57) ABSTRACT

A current transformer adapted for use in an electrical circuit. The current transformer includes a toroidal core and at least one electrical conductor having a portion passing within the toroidal core. The current transformer includes a cooling device having a body made of thermal conducting material and configured so that it has a first portion connected to the electrical conductor at a position upstream from the toroidal core and suitable for absorbing heat from the electrical conductor, and a second portion, spaced apart from the first portion, which is connected to the electrical conductor at a position downstream from the toroidal core and is suitable for transmitting heat to the electrical conductor. The thermal conducting body comprises at least one portion made of an electrically insulating material capable of preventing the current flow through the cooling device itself.

17 Claims, 8 Drawing Sheets

CURRENT TRANSFORMER, PROTECTION DEVICE INCLUDING SUCH TRANSFORMER AND RELATED CIRCUIT BREAKER

CROSS-REFERENCE TO RELATED APPLICATION

This application claims priority under 35 U.S.C. §119(a)-(d) to Italian Patent Application Number BG2009A000031, filed on May 28, 2009, the entire contents of which are hereby incorporated by reference.

BACKGROUND OF THE INVENTION

The present invention relates to an amperometric or differential current transformer equipped with a system capable of improving its cooling.

Moreover, the present invention relates to a protection device of an electrical circuit, for example, a low voltage one, against an overcurrent, a short circuit or a earth leakage current and that comprises such transformer, to a circuit breaker that comprises such transformer and/or such differential protection device, and to an electrical system comprising such circuit breaker.

As known, circuit breakers or similar devices are devices designed for allowing the correct operation of specific parts of electrical systems and of the installed loads. To this end, they are equipped with suitable protection devices, for example, electronic devices protecting against overcurrents, short circuits or differential currents (earth leakage currents or ground fault currents).

Such protection devices, also indicated simply as "relays" or "trip units," can be realized and used as stand-alone components, or more typically they are inserted inside the shell of an automatic circuit breaker and are operatively coupled to its breaking part. The relays are normally associated with some current transformers or amperometric transformers (TA) or current transformers (CT). Normally, the current transformers provide the protection unit with a signal indicating the circulating current at each pole of the circuit breaker; in addition to, or as an alternative to this function, the current transformers are used to supply power to the same protection devices.

Similarly, also the protection devices, in particular the differential type, also referred to simply as differentials or differential relays, can be produced and used as stand-alone components, or more typically are associated with the shell of an automatic circuit breaker and are operatively coupled to its breaking part. The most common components of the amperometric transformers, whether of the unipolar or differential type, comprise a toroidal core, or shortly toroid, on which the so-called secondary windings are positioned; the core is then positioned in such a way as to be passed through, depending on the type of use, by one or more electrical conductors which constitute the so-called primary conductors or windings, each of which is directly or indirectly connected to a corresponding phase of the electrical circuit inside which the device is inserted.

One of the critical issues related to the amperometric transformers, in particular those applied to the automatic circuit breakers, is that the electrical junctions in the conductors that pass through the toroid cause local increases in electrical resistance with resulting production of heat. The heat generated is damaging to the life of the transformer and in particular the delicate secondary windings and their insulation coating. The heat also negatively affects the toroidal core, causing undesirable alterations of the typical B-H response curves.

Also, when the device is inserted inside a circuit breaker, this undesirable heat contributes to increase the temperature of the circuit breaker and then can negatively affect its operation and performance. It also needs to be noted that when the amperometric transformers are connected directly to the output terminals of the circuit breaker, because of thermal conduction phenomena, in practice they result in being exposed to the heat produced by Joule effect on the circuit breaker itself. An excessive increase in the temperature of the circuit breaker can render it necessary to resort to the derating of the circuit breaker itself, i.e to an underuse compared to the nominal data, especially when it is installed inside a switchboard. Besides, it is nevertheless desirable to keep the operating temperature of the circuit breakers at low levels; it is known, in fact, that the higher is the operating temperature, the lower is the life span of the circuit breaker (or of its more sensitive components).

Normally, there is an attempt to solve such problems by increasing the dimensions and the volumes and by using materials that are particularly resistant to heat but are expensive.

Although these known solutions certainly provide some technical benefits, there is room and need for further improvements.

SUMMARY OF THE INVENTION

Therefore, the present invention is directed toward addressing the aforementioned problems by improving the cooling of a current transformer, and, in particular, the warmer parts thereof, such as those in proximity to the core, as well as the circuit breaker in which the current transformer is disposed.

In accordance with the present invention, a current transformer intended for use in an electrical circuit is provided. The current transformer includes a toroidal core and at least one electrical conductor having a section passing through the inside of the toroidal core. The current transformer further includes a cooling device having a body made of thermal conducting material and configured in such a way as to have a first portion that is connected to the electrical conductor in a position upstream from the toroidal core and capable of absorbing heat from the electrical conductor, and a second portion separated from the first portion, which is connected to the electrical conductor at a position downstream from the toroidal core and capable of transmitting heat to the electrical conductor. The thermal conducting body includes at least one portion made of an electrically insulating material capable of preventing current from flowing through the cooling device itself.

BRIEF DESCRIPTION OF THE DRAWINGS

Further characteristics and advantages will become more apparent from the description of some preferred but not exclusive embodiments of the transformer according to the invention, illustrated only by way of non-limiting examples with the aid of the accompanying drawings, wherein.

DETAILED DESCRIPTION OF ILLUSTRATIVE EMBODIMENTS

In the following description, for the purpose of the present invention, the same or technically equivalent elements are indicated with the same reference numbers in the various figures.

Figure 1:
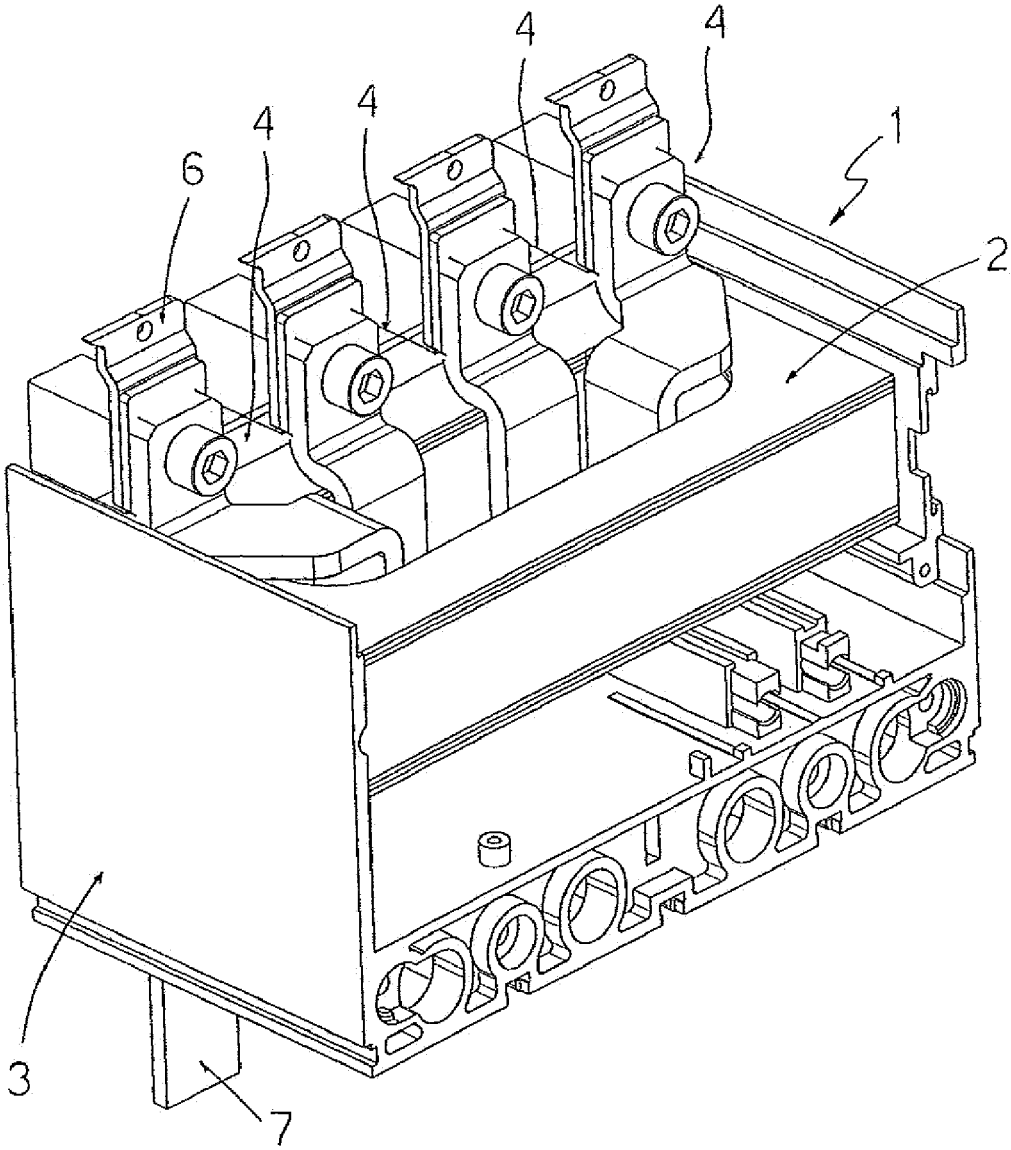
FIG. 1 is a perspective view representing a first embodiment of a current transformer arranged for use inside a low-voltage tetrapolar automatic circuit breaker.
Figure 4:
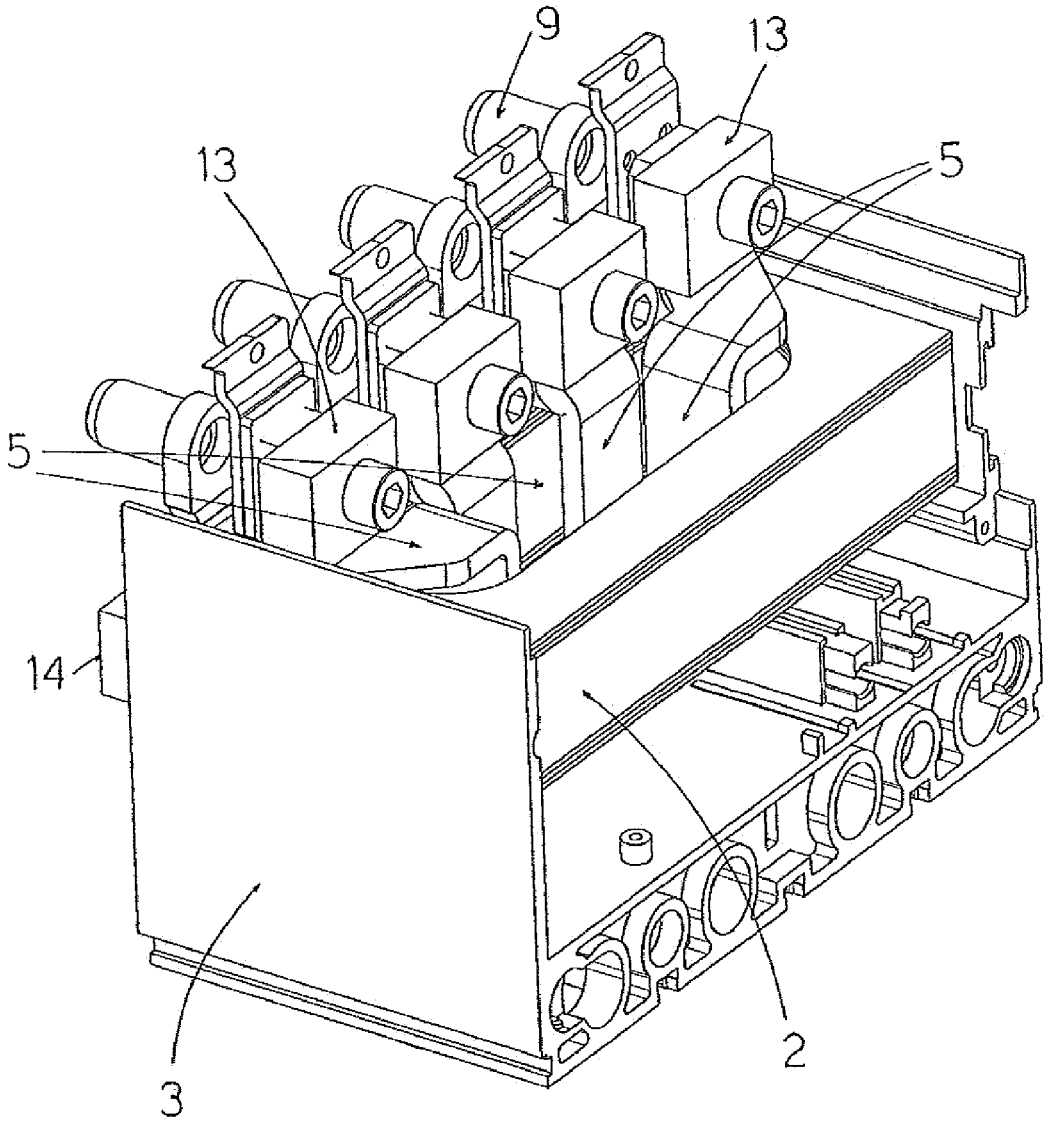
FIG. 4 is a perspective view representing a second embodiment of a current transformer according to the invention arranged for use inside a low-voltage automatic circuit breaker of the withdrawable-type.
Figure 6:
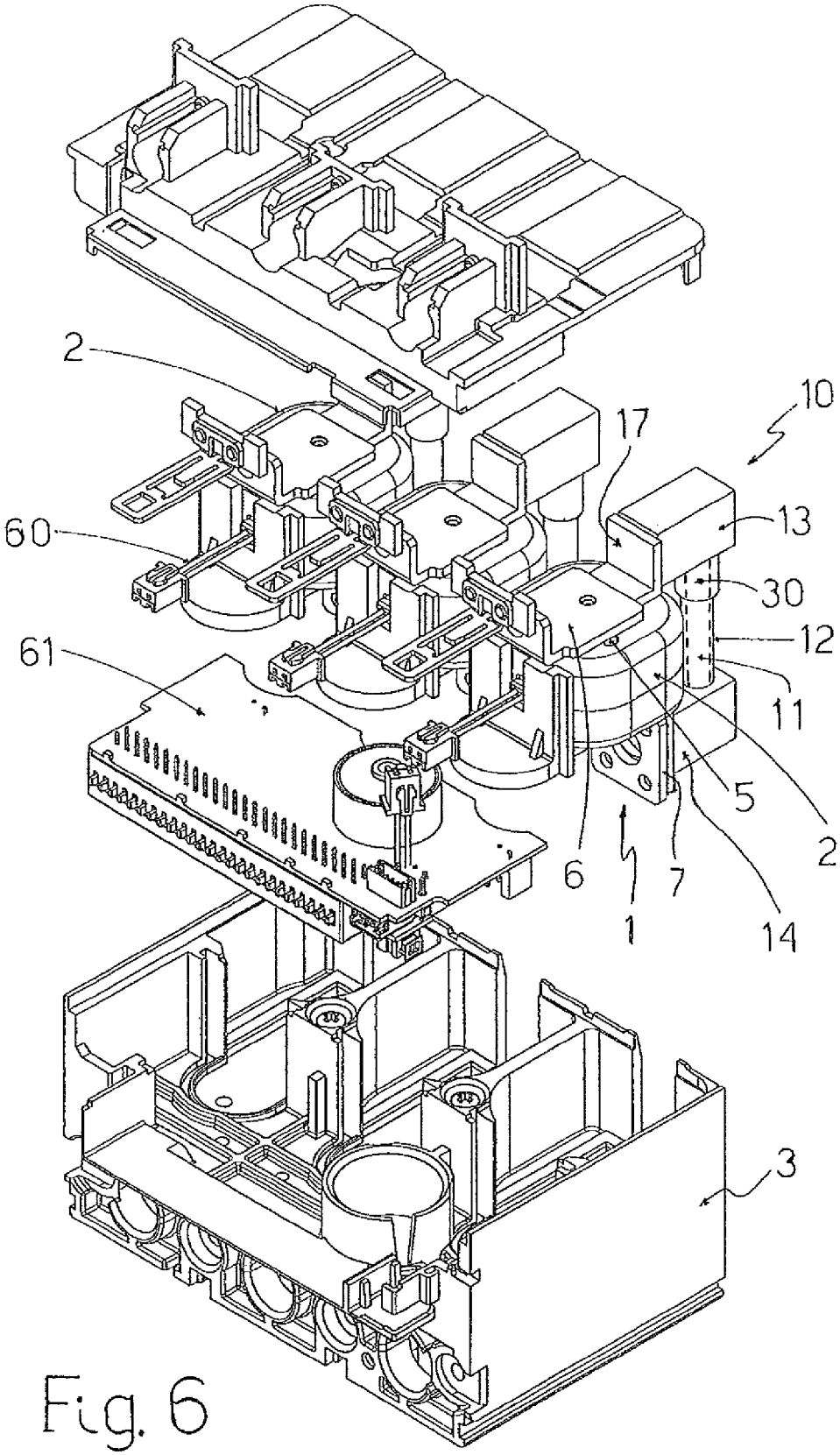
FIG. 6 is an exploded perspective view representing a third embodiment of a current transformer according to the invention intended for use within a low-voltage tripolar automatic circuit breaker.

FIGS. 1 and 4 illustrate two possible embodiments of a current transformer, in both cases indicated by reference number 1, of the differential type, that is intended for detecting differential currents present in the circuit or system inside which the transformer is inserted. FIG. 6 instead illustrates a current transformer 1 of the amperometric type.

Figure 3:
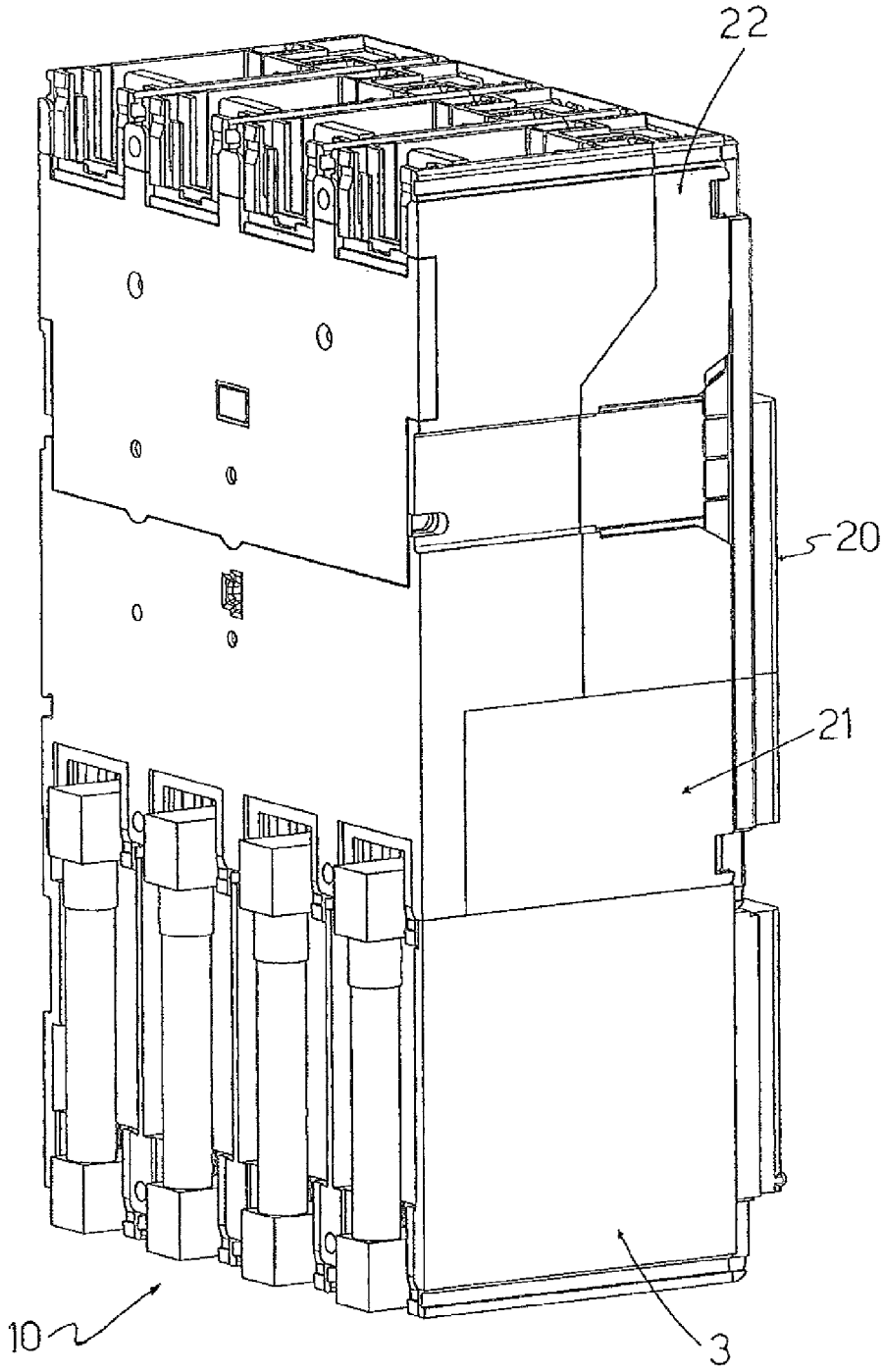
FIG. 3 is a perspective view representing a low-voltage circuit breaker, seen from the back part, and comprising a transformer according to the embodiment illustrated in FIGS. 1-2.

In particular, illustrated in FIG. 1 is a differential transformer 1 intended for use in an automatic circuit breaker 20 of the fixed execution type illustrated in FIG. 3, in FIG. 4 is illustrated a differential transformer 1 intended for use in an automatic circuit breaker of the withdrawable type; illustrated in FIG. 6 is a series of current transformers intended for use in a tripolar circuit breaker.

As illustrated in such figures, the transformer 1 comprises a toroidal core 2, which is usually made of a ferromagnetic material on which the secondary windings are positioned (not illustrated in FIGS. 1, 4, whereas related connection outputs 60 are visible) according to embodiments and operating models which are well known in the art and will not be thereby described in detail.

In the exemplary embodiments of FIGS. 1 and 4, the toroid 2 is housed within a containment shell 3, which is intended to be coupled to an associated portion 21 of the circuit breaker body so as to contribute to the definition of complete box 22 of the circuit breaker itself; in the case in which transformer 1 is made as a stand-alone component to be used individually or to be coupled to a breaker as an additional component, shell 3 could have the configuration of a complete box.

In the example in FIG. 6, various transformers 1 are intended to be housed inside a box 3 of a relay, of which circuit board 61 is illustrated as an example.

Transformer 1 comprises, for each phase of the line or electrical circuit inside which it will be used, at least one electrical conductor, indicated in all cases by reference number 4, which is flown through by the current circulating in the associated circuit.

In particular in the case of a current transformer 1 of the differential type (FIGS. 1 and 4), all of the conductors of the electrical circuit phases (depending on the adopted equipment solution, the neutral could be excluded) pass through the same toroidal core 2; in the case of a transformer 1 of the amperometric type (FIG. 6), each phase conductor 4 passes through a corresponding toroidal core 2.

Therefore, in the following description, for the sake of simplicity, reference will be made to a single phase of the circuit or line inside which transformer 1 is used; such description is clearly to be understood to be applicable in entirely analogous manner to all the phases of the line or circuit in which the current is detected.

Figure 2:
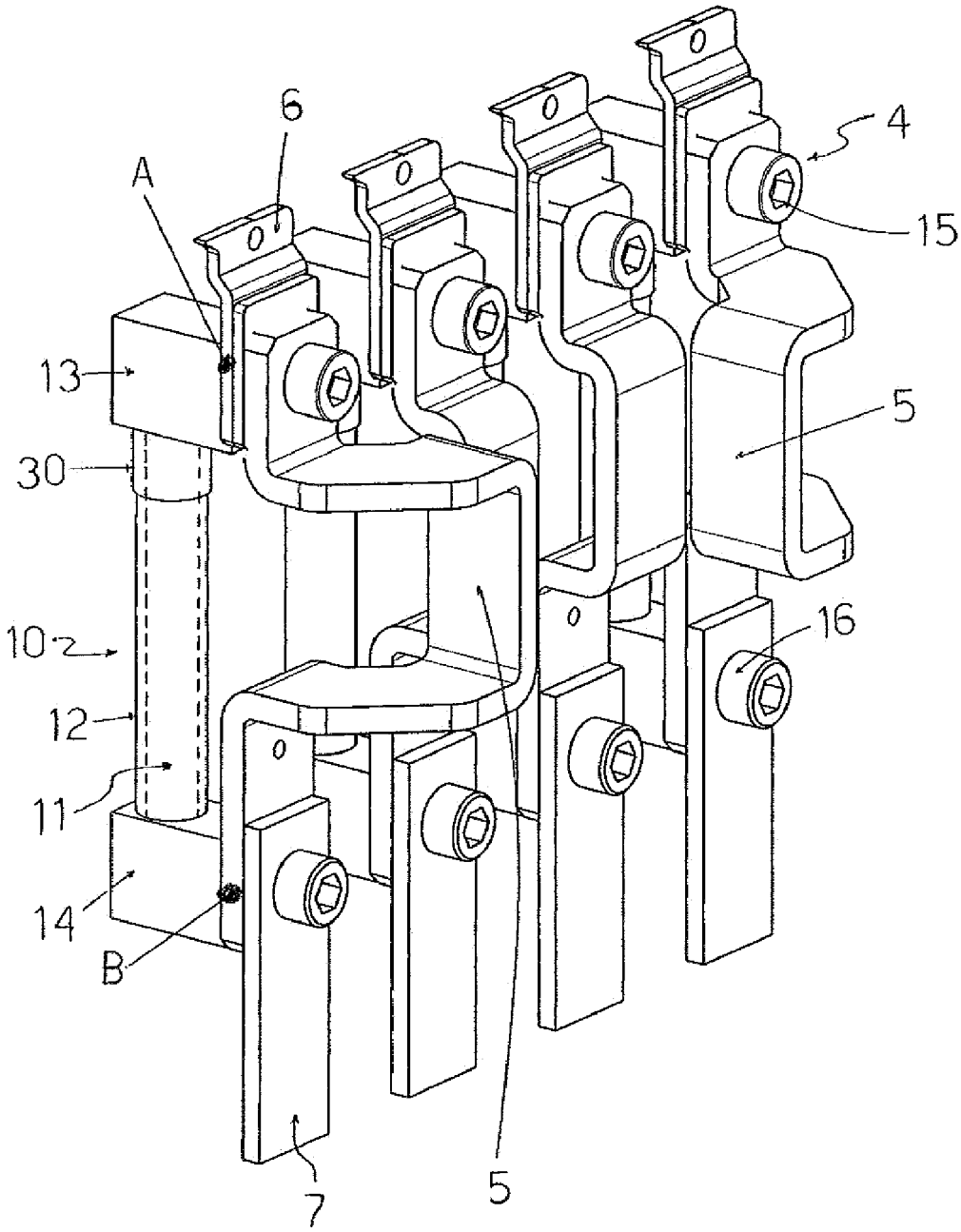
FIG. 2 is a perspective view representing several components of the transformer of FIG. 1.
Figure 5:
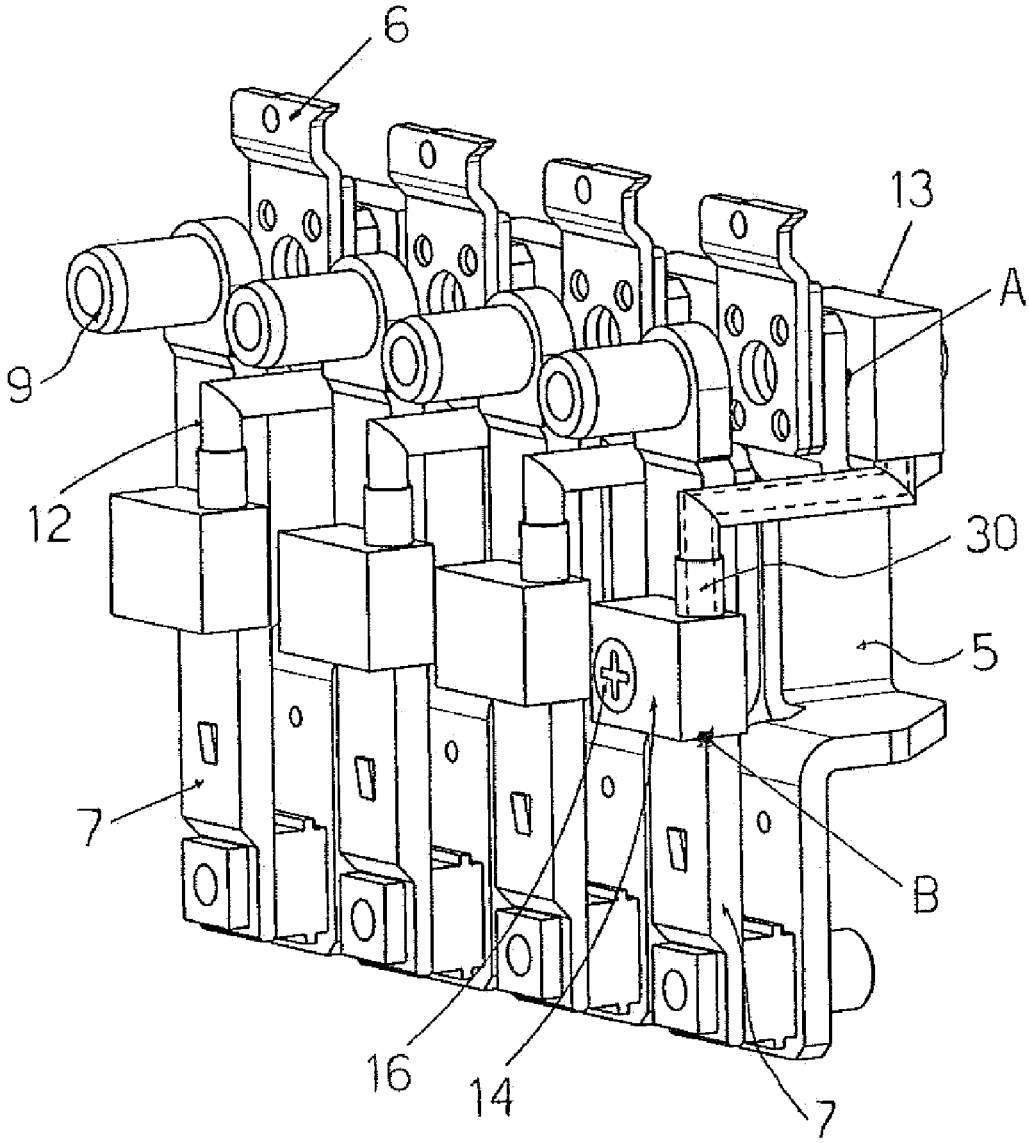
FIG. 5 is a perspective view representing several components of the transformer of FIG. 4.

As better represented in FIGS. 2 and 5, in which shell 3 and toroidal core 2 have been omitted for greater clarity of illustration, the electrical conductor 4 comprises a conductor 5 having a section that passes through inside the toroidal core 2 and therefore constitutes the so-called primary of differential protection device 1.

The conductor 4 can be made up of a single electro-conducting element, or more commonly, of several elements connected to each other in series, as illustrated in the attached figures; in particular, in the example embodiments illustrated in FIGS. 1-2, 4-5, the conductor 4 comprises a first conductor 6, which is intended, for example, for the electrical connection with the true and proper breaking part of circuit breaker 20, which is positioned inside the shell 21. Such breaking part, which itself is known, for each phase comprises a pair of couplable/separable contacts inside an arc chamber; one of the contacts is electrically connected in series to conductor 6. In the example embodiment of FIG. 2, the element 6 is connected to the second conductor 5, which comprises the entire section that passes through core 2; in turn, the lower terminal part of such second conductor 5 is connected to a third conductor 7, which, for example, may constitute an output terminal of the circuit breaker.

In the example illustrated in FIG. 5, each conductor 4 comprises, for example, a first conductor 6 upstream from toroidal core 2, a second conductor 5, and a third conductor 7 downstream from the toroidal core 2, which goes back up toward the upper part.

Both the second conductor 5 and the other sections/components that contribute to form the conductor 4 can be realized by means of rigid elements such as rods, or by flexible elements, such as bare braids, insulated cables or by a combination of rigid and flexible elements, and can, for example, be made of copper, aluminium, etc.

Advantageously, the current transformer 1 according to the invention comprises one cooling device, overall indicated by reference number 10, having a body made of a thermal conducting material and configured in such a way as to have: a first portion that is connected to electrical conductor 4 at a first position (A) upstream (with respect to the flow of the current circulating within the electrical conductor from element 6 to element 7) of toroidal core 2 and capable of absorbing heat from electrical conductor 4; and a second portion, separated from the first portion, that is connected to the electrical conductor at a position (B) downstream (with respect to the flow of the current circulating within the electrical conductor from element 6 to element 7) from the toroidal core 2 and is capable of transmitting heat to the conductor element 4.

Furthermore, the thermal conducting body of the cooling device 10 comprises at least one portion 30 made of material that is electrically insulating but thermal conducting and capable of preventing the current flow through the cooling device itself.

In particular, the thermal conducting body may have a structure made predominantly of electrically conducting material, for example, copper, aluminium or any other commercially available material suitable for the purpose, inside which a portion 30 made of a thermal conducting but electrically insulating material is inserted, for example, ceramics, or a plastic material resistant to high temperatures; alternatively, the body of device 10 could be made completely of a thermal conducting and electrically insulating material, whether this be ceramics or a plastic material resistant to high temperatures, or any other material suitable for the purpose.

Preferably, as illustrated in the attached figures, the cooling device 10 is positioned with the thermal conducting body positioned completely external to the toroidal core 2.

Preferably, the thermal conducting body of cooling device 10 comprises a hermetically sealed cavity 11 (indicated by dashed lines in the figures) which contains a cooling fluid; preferably the cavity 11 comprises a small quantity of vaporizable liquid, for example, water.

Preferably, the walls of the sealed cavity 11 have porous or ribbed internal surfaces.

Advantageously, the thermal conducting body of device 10 is operatively coupled to the electrical conductor 4 such that the hermetically sealed cavity 11 has a first surface positioned in proximity to said position (A) upstream from the toroidal core 2, and a second surface positioned in proximity to said position (B) downstream from the toroidal core 2.

In particular, as illustrated in the examples of FIGS. 1-2 and 4-5 and 6, the thermal conducting body of device 10 comprises at least one hermetically-sealed hollow tubular element 12 whose internal walls therefore constitute surfaces delimiting the cavity 11, which contains the cooling fluid.

Preferably, the device 10 also comprises two suitably shaped plates 13, 14, which are also made of thermal conducting material, such as for example, aluminium or copper. The two plates 13 and 14 are connected to opposite ends of tubular element 12 and can be equipped, one or both, with suitable holes capable of receiving fastening means, such as screws 15, 16, with one of the components of conductor 4.

In particular in the examples illustrated in FIGS. 1 and 2, a single screw 15 connects between them the plate 13 with one end of the conductor 5 and with an end of the conductor 6 interposed between them.

In the example of FIGS. 1 and 2, the plate 14 is directly connected via another single screw 16 to the conductor 7 and to the conductor 5 interposed between them; in the exemplary embodiment in FIGS. 4 and 5, the plate 14 is connected via another single screw 16 (illustrated for simplicity sake just for one phase) to the conductor 7, which is configured in a way as to go back up. Such configuration can be used, for example, when the transformer 1 (or the protection device inside which it is used) is intended for use in a circuit breaker of the withdrawable-type inside which the circuit breaker can be connected/withdrawn rapidly in an adapter positioned, for example, inside a switchboard; to this end, in fact, the conductor 7 shows a plug cylinder 9 intended to be connected to a corresponding conductor socket provided on the adapter.

In the various exemplary embodiments, the hollow tubular element 12, which can be of a rectilinear design (FIGS. 1, 2, 6) or shaped in various ways (FIGS., 4, 5), is positioned so that the hermetically sealed cavity 11 has a first exchange surface positioned at the first plate 13 and a second thermal exchange surface, separated from the first surface, which is positioned at the second plate 14.

Furthermore, the hollow tubular element 12 comprises at least one portion 30 made of an electrically insulating material, for example, ceramic. In the illustrated examples, this portion 30 may be constituted by a collar or cap positioned at one end of the tubular element 12 at the plate 13 (FIGS. 1-2, 3) or in proximity of the plate 14 (FIGS. 4-5).

This portion 30, made of electrically insulating material, prevents the current flow through the device 10; in this way, the detection of the currents is not affected by the device 1.

In practice, the plate 13 acts as a heat collector at position (A) inside which is located, for example, the junction of the collector 6, which, being connectable to the contacts of the circuit breaker, represents a particularly critical point for the heating; the first surface of the sealed cavity 11 absorbs (directly or indirectly) heat produced by the area of position (A) 21 and conveys it to the second surface of cavity 11. The second surface transmits heat to plate 14, which acts as a diffuser and transmits heat (directly or indirectly) to the downstream electrical system; with particular reference to FIGS. 1, 2, it is to be noted that conductor element 7, which is really part of the downstream electrical system, is operatively associated with position B.

In conclusion, this is a thermal circuit that has: a warmer section immediately upstream of toroidal core 2 and which is found in proximity to the conductors that can be placed in direct contact with the real breaking part inside the circuit breaker, that is with the part of the circuit breaker that can reach high temperatures; and a "cooler" section separated from the warmer section that can be found at any point of the path of the electrical connection downstream from the toroidal core 2 wherein the temperature does not have a particular effect on the operation of transformer 1, as well as the protection device or circuit breaker inside which it may be used. The warmer section acts as an evaporator for the cooling fluid placed inside the sealed cavity, while the cooler section acts as a condenser; basically, a "thermal short circuit" is achieved between the two sections (A) and (B) of the electrical chain characterized by very different temperatures, wherein the device 10 absorbs heat at its warmer section, transferring it to the cooler section which then transfers it to the areas in contact with it (towards the electric line).

It has been observed in practice how the transformer 1, according to the invention, allows to accomplish the intended scope by providing several significant improvements with regard to the known solutions; in fact, the cooling device 10 keeps the toroid 2 much colder than the known solutions.

Furthermore, the transformer 1 has a simple structure that is easy-to-use in any electrical system as a stand-alone component or associated with any type of protection device, for example, an electronic relay, even just to supply it with electrical power, or with a circuit breaker.

Therefore further objects of the present invention include: a device for protecting an electrical circuit against failures, for example, because of overcurrent or short circuit or earth leakage current, characterized in that it comprises a current transformer 1 as previously described and defined in the appended claims; a circuit breaker, for example, of the low-voltage type, characterized in that it directly comprises a current transformer 1 as previously described and defined in the appended claims, or comprising a protection device, as defined above, having in turn a current transformer 1; or finally, an electrical system, for example, of the low-voltage type, characterized in that it comprises a current transformer as previously described and defined in the appended claims or characterized in that it comprises a protection device as defined above comprising such transformer 1, or again characterized in that it comprises a circuit breaker comprising such transformer 1 or such protection device having the transformer 1 itself.

In this way, all conditions being equal, the use of a transformer 1 with cooling device 10 allows to have in particular a circuit breaker with improved performance and which can be used with a rating potentially higher than an equal circuit breaker which is not provided with such a transformer 1.

Figure 7:
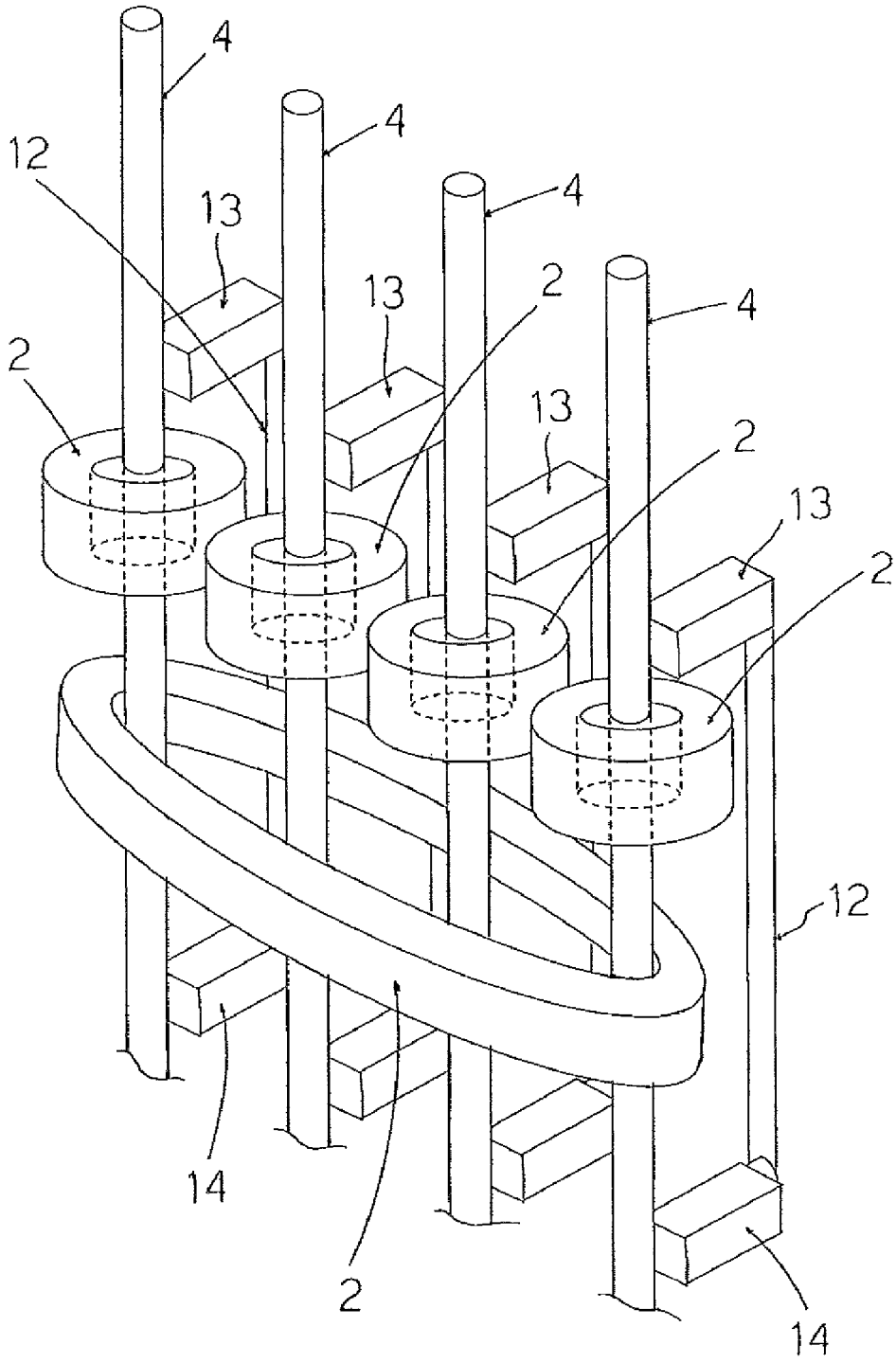
FIG. 7 illustrates schematically a possible combination of the transformers illustrated in FIGS. 1 and 6.
Figure 8:
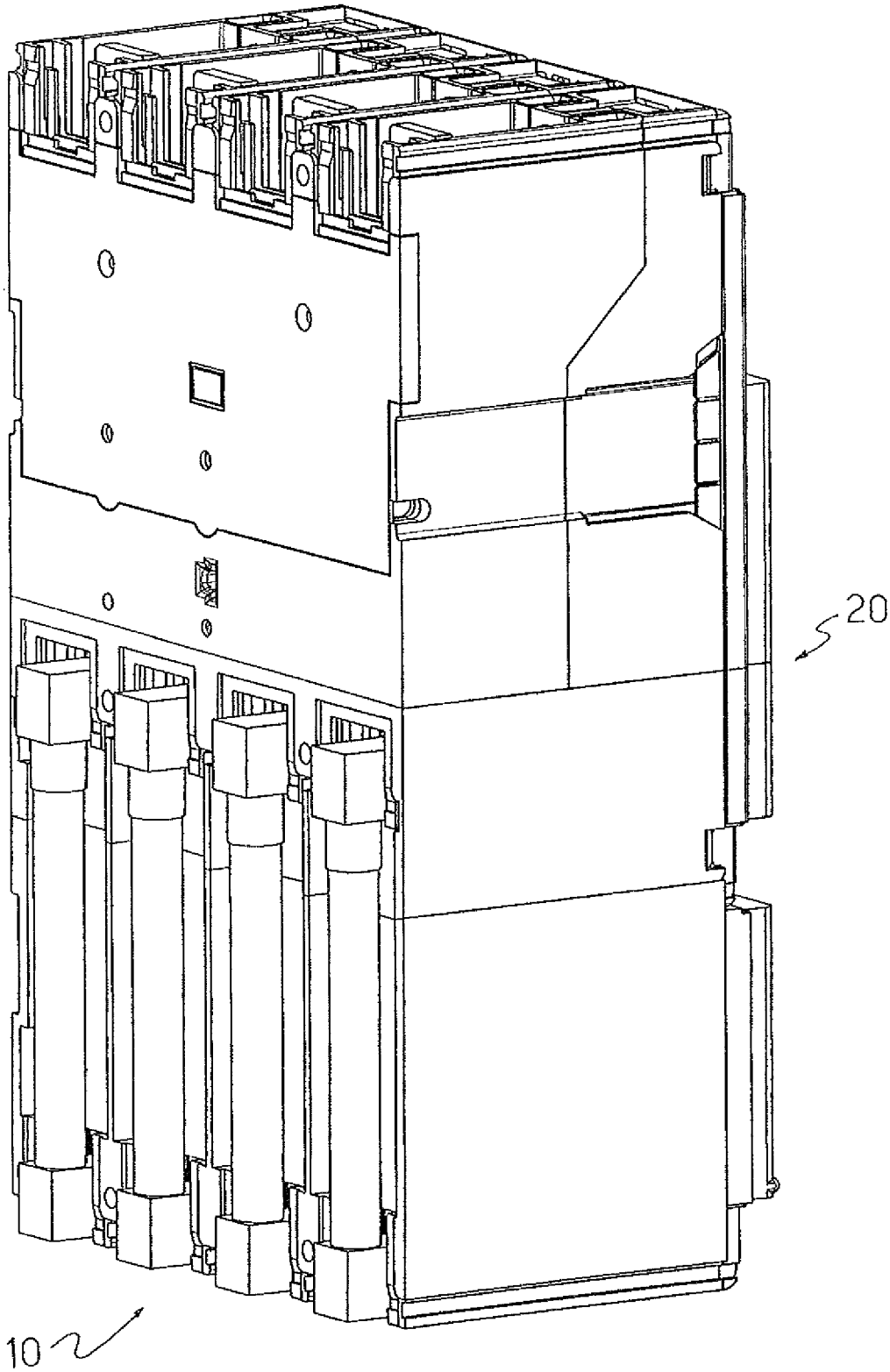
FIG. 8 is a rear view of a tetrapolar circuit breaker employing the combination illustrated in FIG. 7.

The transformer 1 thus conceived is susceptible to numerous changes and variants, all of which are within the scope of the inventive concept; additionally, all details can be replaced by other equivalent technical elements. For example, for each phase, the number of tubular elements as well as their configuration, e.g. rectilinear, curved, or mixed, can be varied; plates 13, 14 can be shaped differently and can be formed by several pieces connected to each other; the device may comprise a connection element that consolidates the assembly of the components intended for each phase and makes device 10 a single block that can be applied as a separate module. Also the methods for fastening plates 13 and 14 to the conductors of phase 4 can be selected according to technical and economic convenience (for example, screws, bolts, rivets or welds). Moreover, it is possible to carry out any combination of the illustrated examples described at the outset. To this end, FIGS. 7 and 8 illustrate a further configuration wherein there is a combination of the embodiments of the transformer 1 illustrated in FIGS. 1 to 6. In particular, as schematically illustrated in FIG. 7, each phase conductor 4 first passes through a respective toroidal core 2 (first toroidal core); the assembly of the conductors 4 then passes as a unit through a single second toroidal core 2; in this case, the cooling device 10 comprises a thermal conducting body of the type previously described and which has a first portion that is connected to the corresponding conductor 4 at a first position upstream from the first toroidal core 2 and is capable of absorbing heat from such electrical conductor 4, and a second portion separated from the first portion which is connected to the same electrical conductor 4 at a position downstream from the second toroidal core 2 and is capable of transmitting heat to the conductor element itself. Also in this case, the thermal conducting body comprises at least one portion made of electrically insulating material capable of preventing the current flow through the cooling device itself.

In practice, the materials, as well as the dimensions, can be of any kind according to the requirements and state of the art.

What is claimed is:

1. A current transformer adapted for use in an electrical circuit, the current transformer comprising:

a toroidal core and at least one electrical conductor having a portion passing within said toroidal core;

a cooling device having a body made of thermal conducting material and configured so that it has a first portion connected to said electrical conductor at a first position upstream from the toroidal core and suitable for absorbing heat from the electrical conductor, and a second portion, spaced apart from the first portion, which is connected to the electrical conductor at a position downstream from the toroidal core and is suitable for transmitting heat to the conductor element, said thermal conducting body comprising at least one portion made of an electrically insulating material capable of preventing current from flowing through the cooling device.

2. A current transformer according to claim 1, wherein said cooling device is positioned with said thermal conducting body placed externally to the toroidal core.

3. A current transformer according to claim 1, wherein said thermal conducting body of the cooling device is completely made of a thermal conducting and electrically insulating material.

4. A current transformer according to claim 1, wherein said thermal conducting body comprises at least one hermetically sealed cavity that contains a cooling fluid.

5. A current transformer according to claim 4, wherein said thermal conducting body is operatively coupled to said electrical conductor in such a way that said hermetically sealed cavity has a first surface positioned at said position upstream from the toroidal core and a second surface positioned at said position downstream from the toroidal core.

6. A current transformer according to claim 4, wherein the walls of said sealed cavity have internal surfaces which are ribbed or porous.

7. A current transformer according to claim 1, wherein said thermal conducting body comprises at least one hermetically sealed hollow tubular element that contains said cooling fluid.

8. A current transformer according to claim 7, wherein said thermal conducting body comprises a first plate and a second plate positioned at and connected to the opposite ends of said hollow tubular element.

9. A current transformer according to claim 7, wherein said hollow tubular element comprises said at least one portion made of electrically insulating material.

10. A device for protecting an electrical circuit against faults, wherein the device comprises a current transformer according to claim 1.

11. A circuit breaker comprising a protection device according to claim 10.

12. An electrical system wherein it comprises a protection device according to claim 10.

13. A circuit breaker comprising a current transformer according to claim 1.

14. An electrical system comprising a circuit breaker according to claim 13.

15. An electrical system comprising a current transformer according to claim 1.

16. A circuit breaker comprising:

a first toroidal core and at least one second toroidal core;

at least one electrical conductor passing within said first and second toroidal cores; and a cooling device having a body made of thermal conducting material and configured so that it has a first portion connected to said electrical conductor at a first position upstream from the first toroidal core and suitable for absorbing heat from the electrical conductor, and a second portion, spaced apart from the first portion, which is connected to the electrical conductor at a position downstream from the second toroidal core and that is suitable for transmitting heat to the conductor element, said thermal conducting body comprising at least one portion made of an electrically insulating material capable of preventing the current flow through the cooling device itself.

17. An electrical system comprising a circuit breaker according to claim 16.

* * * * *